US005142857A

United States Patent [19]

Matsui

[11] Patent Number: 5,142,857

[45] Date of Patent: Sep. 1, 1992

[54] METHOD AND APPARATUS FOR PRODUCING YARNS

[75] Inventor: Isamu Matsui, Kyoto, Japan

[73] Assignee: Murata Kikai Kabushiki Kaisha, Kyoto, Japan

[21] Appl. No.: 485,935

[22] Filed: Feb. 27, 1990

[30] Foreign Application Priority Data

Mar. 1, 1989 [JP] Japan ..... 1-49050

[51] Int. Cl.[5] ..... D01H 5/28; D01H 7/92; D01H 9/14; B65H 54/02

[52] U.S. Cl. ..... 57/281; 57/328; 242/35.5 A

[58] Field of Search ..... 57/315, 328, 333, 281, 57/90, 58.49; 242/35.5 A

[56] References Cited

U.S. PATENT DOCUMENTS

| | | | |
|---|---|---|---|
| 3,429,113 | 2/1969 | Nimtz et al. | 57/281 |
| 4,055,039 | 10/1977 | Moushovich et al. | 57/333 X |
| 4,212,433 | 7/1980 | Matsui et al. | 242/35.5 A |
| 4,470,253 | 9/1984 | Schulz et al. | 57/315 |
| 4,598,869 | 7/1986 | Uchida et al. | 57/281 X |
| 4,605,177 | 8/1986 | Uchida et al. | 242/35.5 A |
| 4,660,370 | 4/1987 | Matsui et al. | 57/281 |
| 4,718,560 | 1/1988 | Kiriake | 242/35.5 AX |
| 4,729,709 | 3/1988 | Raasch | 242/35.5 AX |
| 4,928,475 | 5/1990 | Matsui et al. | 57/281 X |
| 4,942,731 | 7/1990 | Morihashi et al. | 57/328 |

FOREIGN PATENT DOCUMENTS

| | | | |
|---|---|---|---|
| 54-3988 | 2/1979 | Japan | 57/328 |
| 515672 | 3/1938 | United Kingdom | 57/328 |

*Primary Examiner*—Daniel P. Stodola
*Assistant Examiner*—Michael R. Mansen
*Attorney, Agent, or Firm*—Spensley Horn Jubas & Lubitz

[57] ABSTRACT

In a system for producing yarns comprising a spinning apparatus having a plurality of spinning units, each unit being provided with a winding device, and a twisting machine directly connected to said spinning apparatus to twist a package from the spinning apparatus, a method comprises feeding packages of different kinds of yarns doffed from a group of units obtained by dividing units of the spinning apparatus to the twisting machine at different timing, and supplying them onto trays discriminated by kinds in the twisting machine.

9 Claims, 8 Drawing Sheets

METHOD AND APPARATUS FOR PRODUCING YARNS

FIELD OF THE INVENTION

This invention relates to a yarn producing apparatus. More particularly, the invention relates to an apparatus capable of automatically sorting and producing different kinds of yarns to automatically twist them.

RELATED ART STATEMENT

In spun yarns produced by a ring spinning machine and other spinning machines (such as an open end spinning machine, a pneumatic spinning machine, etc.), two or more yarns are drawn and arranged, wound back and doubled by a doubler for the purpose of eliminating an unevenness of coarseness, averaging a twisting torque applied during spinning, and the like. A twist is applied by a two-for-one twister to the yarns on the doubler to increase the strength of yarns and fuzz is incorporated therein to provide yarns having a very smooth surface in the post treatment.

The yarns produced by the spinning machine often have a sufficient strength only after they have been subjected to the aforementioned post process and become excellent yarns which are suitable for weaving and knitting processes with less fuzz.

However, the aforesaid post-process comprises a multitude of steps including carrying a yarn spun by the spinning machine to a doubler, doubling the yarn by said doubler, carrying the doubled yarn to a two-for-one twister, and twisting the yarn by the two-for-one twister, which inevitably require much labor and time or many carrier apparatuses in place of persons Simplification of these steps has been heretofore investigated.

For the purpose of simplifying the steps as described above, for example, Japanese Utility Model Publication No. 33006/1986 , is disclosed, in which as a feed package to a two-for-one twister, two packages from an automatic winder are superposed up and down, and twisting and doubling are carried out by the two-for-one twister.

In the aforementioned Japanese Utility Model Publication No. 33006/1986, the doubling step by the doubler may be omitted. However, as the yarn supply package in the two-for-one twister, the special form is required in which the packages from the winder are stacked in two stages. Therefore, the exchanging operation of the yarn supply package is cumbersome, and the release tension from the upper and lower packages is different, inevitably resulting in an occurrence of another trouble in that yarn-cut often occurs in the two-for-one twisting process.

SUMMARY AND OBJECT OF THE INVENTION

It is therefore an object of the present invention to provide a method and apparatus for producing yarns which can eliminate the occurrence of problems as noted above, can simplify the aforementioned post-step, can automatically sort and produce different kinds of yarns and can automatically twist these yarns.

It is another object of the invention to handle a variety of yarns.

For solving the aforesaid task, a method according to the invention comprises, in a system for producing yarns comprising a spinning apparatus having a plurality of spinning units, each unit being provided with a winding device, and a twisting machine directly connected to said spinning apparatus to twist a package from the spinning apparatus, feeding packages of different kinds of yarns doffed from a group of units obtained by dividing units of the spinning apparatus to the twisting machine at different timing, and supplying them onto trays discriminated by kinds in the twisting machine.

In addition, an apparatus of the invention, in which a spinning apparatus having a plurality of spinning units, each unit being provided with a winding device, and a twisting machine having a circulating conveyor for trays which receive packages from said spinning apparatus are connected by a carrier conveyor for winding packages from said spinning apparatus and a yarn supply package exchanger, said plurality of spinning units being further divided into a plurality of unit groups, comprising a storage device for temporarily storing winding packages of different kind of yarns which are supplied from said unit groups to said carrier conveyor by the respective unit groups, said trays being discriminated into the same number of kinds as the number of said divided unit groups, said circulating conveyor being provided with a sorting device for sorting said trays by kinds, and a selection means for selecting the trays transferred from said sorting device to said yarn supply package exchanger, said selection means and said storage device being operatively connected so that the winding package corresponding to the tray selected by said selection means and transferred to the yarn supply package exchanger is supplied to said yarn supply package exchanger.

DETAILED DESCRIPTION OF PREFERRED EMBODIMENT

Embodiments will be described hereinafter with reference to the drawings.

Figure 1:
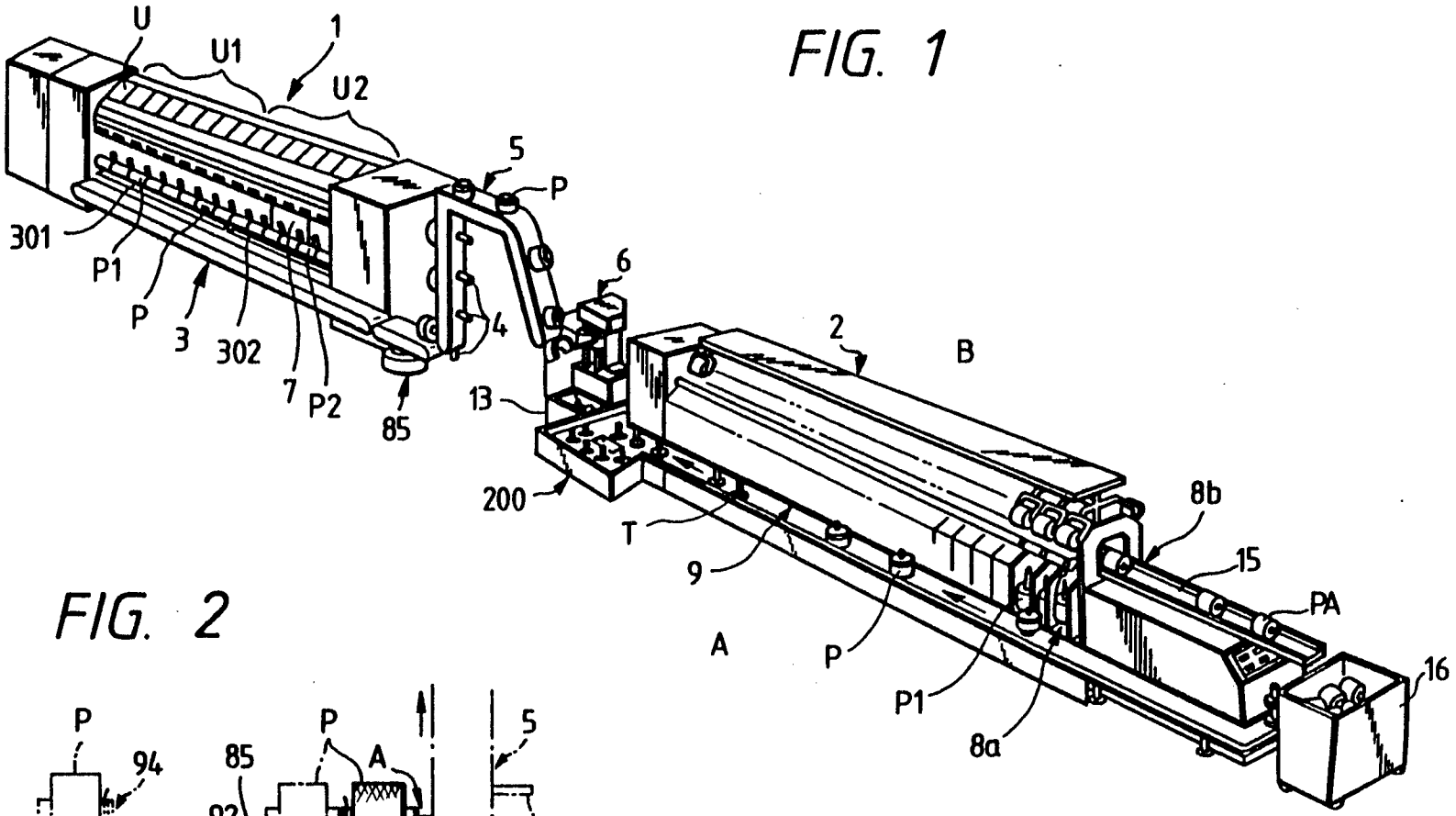
FIG. 1 is a perspective view of the whole producing apparatus according to the present invention.

FIG. 1 is a perspective view of the whole yarn producing apparatus according to this invention.

In this apparatus, a so-called pneumatic spinning machine 1 wherein a material sliver after draft is twisted by air jet to provide a spun yarn and a two-for-one twister 2 are connected by a carrier conveyor 3 comprising a belt conveyor which runs directly before the spinning machine 1, a gate conveyor 5 with peg 4 and a yarn supply package exchanger 6

The aforesaid pneumatic spinning machine 1 is composed of a plurality of spinning units U. A winding package P having a yarn of predetermined length produced by each unit U is delivered onto and doffed by the carrier conveyor 3 by pushing open a cradle of the winding device by an automatic doffing carriage which is movable along the unit U.

The spinning units U each comprise a draft device 101 which will be described later, a twisting device 102 wherein a drafted sliver S is twisted by air jet, and a winding device 103 for winding the spun yarn (see FIG. 11).

In the present embodiment, the plurality of units are divided into two unit groups U1 and U2, so that winding packages P1 and P2 for yarns of different kinds are produced by each unit group.

Between the unit groups U1 and U2 and the carrier conveyor 3 are provided storage devices 301 and 302 for temporarily storing the winding packages P1 and P2 by the respective unit groups U1 and U2. The storage devices 301 and 302 are formed from plates which rotate in direction indicated by arrow a - b as shown in FIG. 11, so that when in the direction of 'a', the winding package P1 or P2 to be supplied from the unit group U1 or U2 to the carrier conveyor 3 is stored, whereas when in the direction of 'b', the packaged having been stored is released and supplied to the carrier conveyor 3. The rotatable plate 301 is present over the full length of the unit group U1 and the rotatable plate 302 is present over the full length of the unit group U2, so that they may be independently turned in said directions indicated by the arrow. This rotating operation is operatively connected to a selection means which will be described later.

The two-for-one twister 2 connected to the spinning machine 1 has a number of spindles 8*a*, 8*b* arranged back to back The winding package P1 is mounted on the spindle 8*a*, and the winding package P2 is mounted on the spindle 8*b*. A feed package carrying conveyor 9 is installed in a closed loop fashion in the periphery of the machine bed to thereby form a tray circulating conveyor. The yarn-supply package P (i.e., the winding package P1 or P2, the same will be applied hereinafter) and an empty package, that is, an empty bobbin B from which all yarns are taken up to be empty and which remains stood upright on the tray, are present on the conveyor 9 in the mixed form for transfer. A full package PA is delivered to the full spindle by an operator or a robot, and the empty bobbin within the spindle is replaced by a yarn supply package on the conveyor 9 to re-open winding.

A yarn supply package exchanger 6 is installed between the carrier conveyor 3 next to the spinning machine 1, the gate conveyor 5 and the two-for-one twister 2 so that an empty bobbin B transferred on the conveyor 9 is removed from a package carrier medium (referred to as a tray), and a yarn supply package P transferred from the spinning machine is supplied and mounted. Reference numeral 13 designates an empty bobbin box which receives empty bobbins removed from the tray.

Figure 17A:
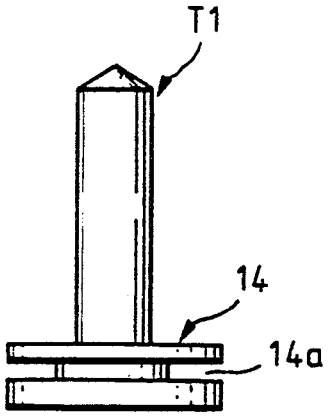
FIGS. 17*a* and 17*b* are front views showing two kinds of trays.
Figure 17B:
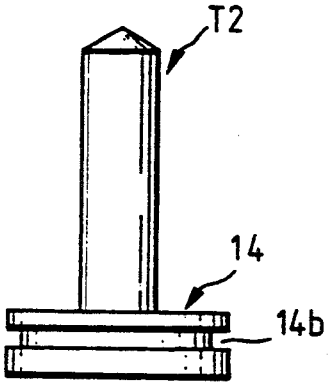

In the present embodiment, two unit groups U1 and U2 are formed, corresponding to which a tray T is discriminated into two kinds of trays T1 and T2 as shown in FIGS. 17*a* and 17*b*. These trays T1 and T2 are different in the depth of ring-like grooves 14*a* and 14*b* formed in a base 14 thereof, whereby they are discriminated.

Figure 16:
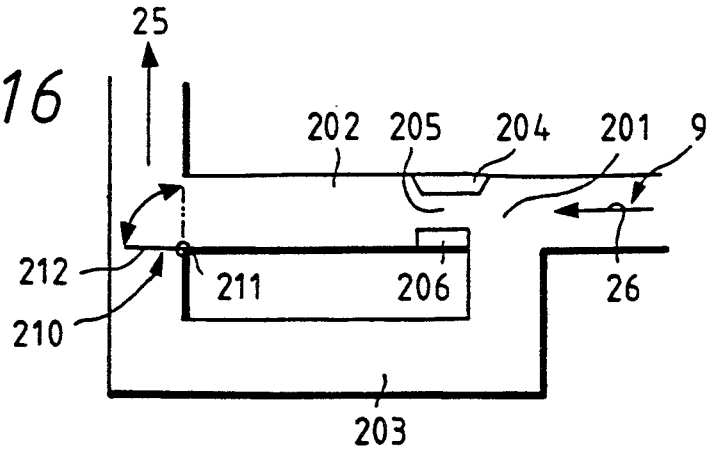
FIG. 16 is a plan view showing a sorting device for discriminated trays.

On the conveyor 9 is provided a sorting device 200 for sorting the aforesaid two kinds of trays T1 and T2. The sorting device 200 comprises, as shown in FIG. 16, two passages 202 and 203 formed through a branch point 201 on the conveyor 9, and sorting plates 204 and 205 for portioning out the trays T1 and T2 to the passages 202 and 203. The sorting plates 204 and 205 are projected at positions corresponding to grooves 14*a* and 14*b* of the tray from the side wall in the vicinity of the branch point of the passage 202, a spacing 206 of which is determined so that the tray T1 having a deep groove 14*a* may pass therethrough but the tray T2 having a shallow groove 14*b* may not pass therethrough. Accordingly, if the tray transferred in the direction indicated by the arrow 26 in FIG. 16 is T1, this is guided to the passage 202 and if it is T2, this is guided by the sorting plates 204 and 205 to the passage 203.

In FIG. 16, reference numeral 210 denotes a selection means which comprises a shaft 211 rotated by a suitable drive means and a stopper 212 fixed to the shaft 211. The stopper 212 is confronted to the passage 202 or 203 to stop the tray T1 or T2 being moved along these passages That is, when the stopper 212 closes the passage 203 as shown by the solid line in FIG. 16, the tray T is stored whereas the tray T1 is supplied from the passage 202 to the aforementioned package exchanger 6. When the stopper 212 closes the passage 202 as indicated by the broken line in the same figure, the tray T1 is stored whereas the tray T2 is supplied from the passage 203 to the package exchanger 6.

The selection means 210 is operatively connected to the storage devices 301 and 302 so that when the tray T1 is supplied to the package exchanger, the storage device 301 of the unit group U1 is released and the winding package P1 is supplied to the package exchanger 6, whereas when the tray T2 is supplied to the package exchanger 6, the storage device 302 of the unit group U1 is released and the winding package P2 is supplied to the package exchanger 6.

In FIG. 1, the full package PA doffed by the two-for-one twister 2 is delivered onto the conveyor belt 15 which travels between the spindles 8*a* and 8*b* provided back to back and is received into the package receiving carriage 16 sideway of the machine bed.

While in the present embodiment, one spinning machine and one two-for-one twister are connected, it is to be noted of course that one spinning machine and plural two-for-one twister may be connected in order to balance the production quantity, or plural spinning machines and one two-for-one twister are connected, or plural spinning machines and plural two-for-one twister are connected by a common carrier passage.

In the above-described embodiment, an operator may pass under the gate conveyor to pass between the spinning machine 1 and the two-for-one twister 2. A plurality of packages may be stored on the gate conveyor 5. A buffer function can be provided between the production quantity of packages by the spinning machine 1 and the processing quantity by the two-for-one twister 2.

Figure 3:
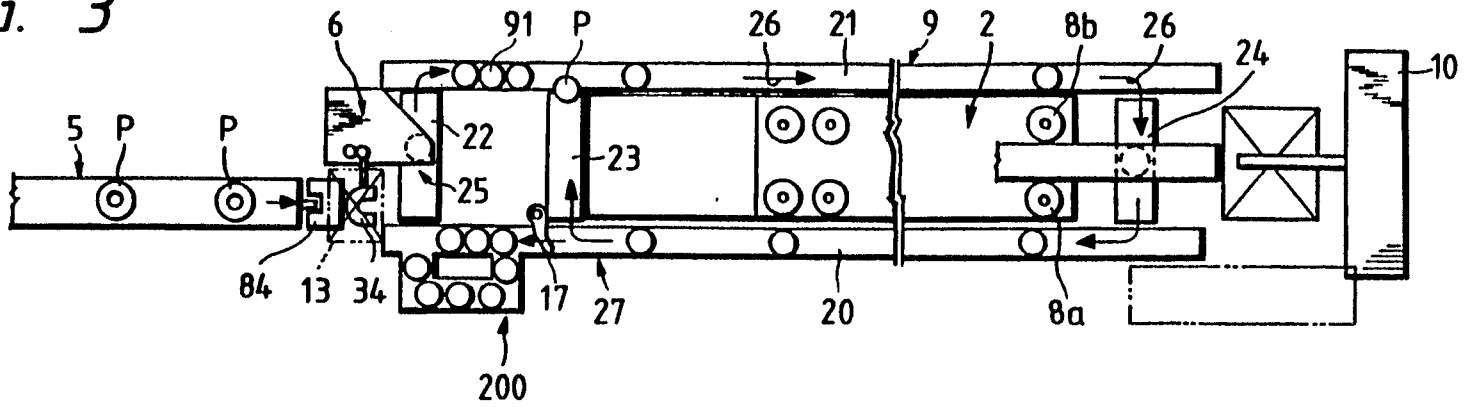
FIG. 3 is a schematic plan view of a two-for-one twister.
Figure 4:
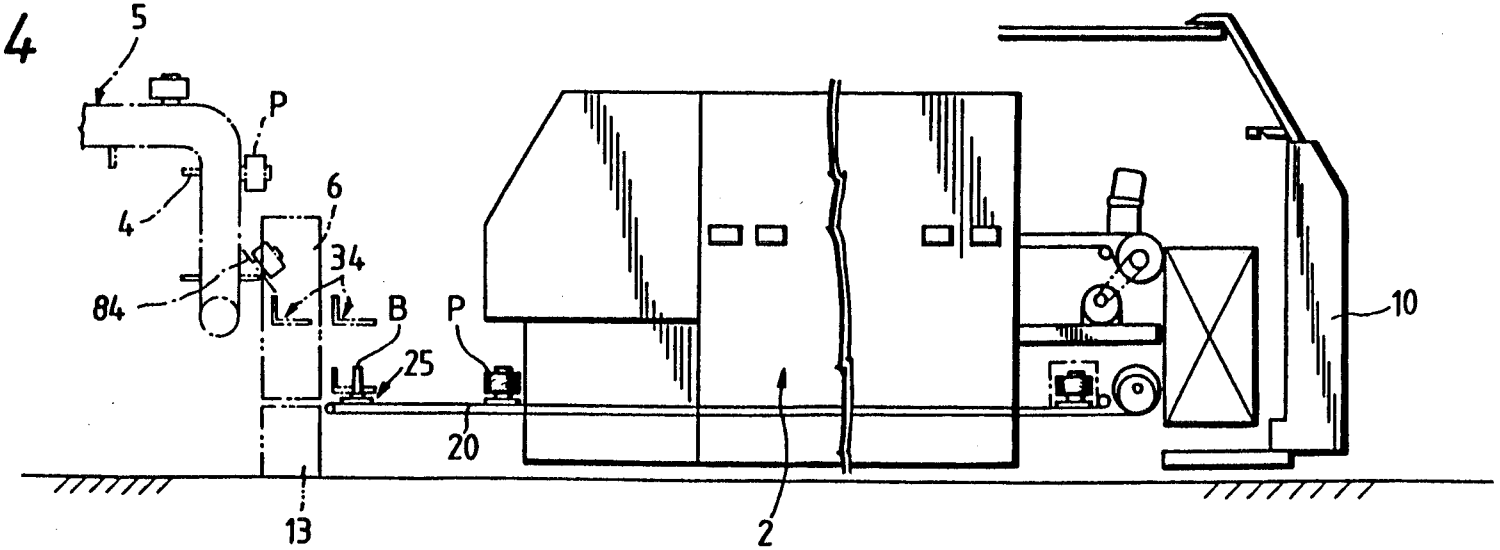
FIG. 4 is a side view thereof.

FIGS. 3 and 4 show the arrangement of a carriage type automatic doffing robot 10 in the system shown in FIG. 1. Conveyors 22, 23 and 24 are provided between conveyors 20 and 21 installed along the spindles 8*a* and 8*b* of the two-for-one twister 2, and a feed exchange station 25 is provided halfway of the conveyor 22. Accordingly, a full feed P and an empty bobbin B are present in a mixed fashion on the feed transferred in the direction of arrow 26 on the conveyors 21, 24 and 20. At a branch point 27, the full feed P and the empty bobbin B are discriminated by a well known feeler or a photoelectric switch for detecting the presence or absence of a yarn layer on the bobbin so that only the full feed is transferred onto the conveyor 23 by switching the point whereas the empty bobbin B moves straight on the conveyor 20 and is moved to a feed exchange station 25 through the sorting device 200.

As the point switching device, there is mentioned a lever device 17 shown in FIG. 3 which is turned by a feeler as a discriminator for the full feed P and the empty bobbin B.

Figure 5:
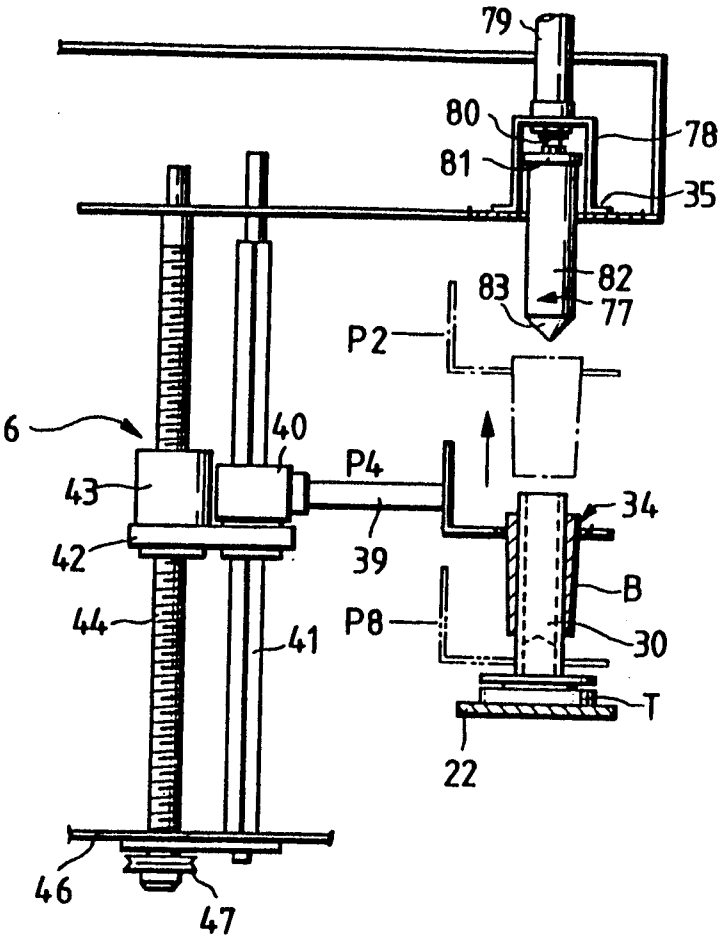
FIG. 5 is a side view of a feed exchange device.

Next, the aforesaid feed package exchange device 6 will be described with reference to FIGS. 5 to 10. In FIG. 5, the exchange device 6 is composed of a package receiver 34 which can be slidably moved up and down and can be turned, and a guide device 35 for locating and guiding a package when a package is mounted on a cylindrical support 30 on the tray.

Figure 8:
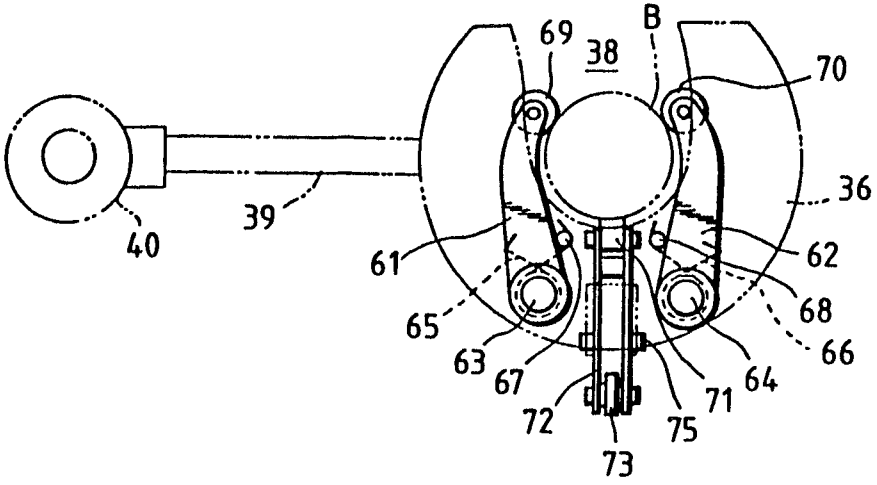
FIG. 8 is a plan view of a bobbin holding device at the bottom of a receiver.
Figure 9B:
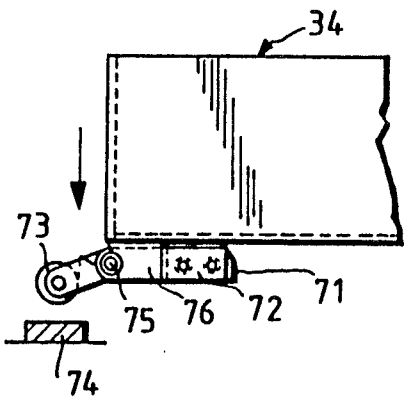
FIG. 9*b* is a view showing the state where the receiver is at a down position.
Figure 9A:
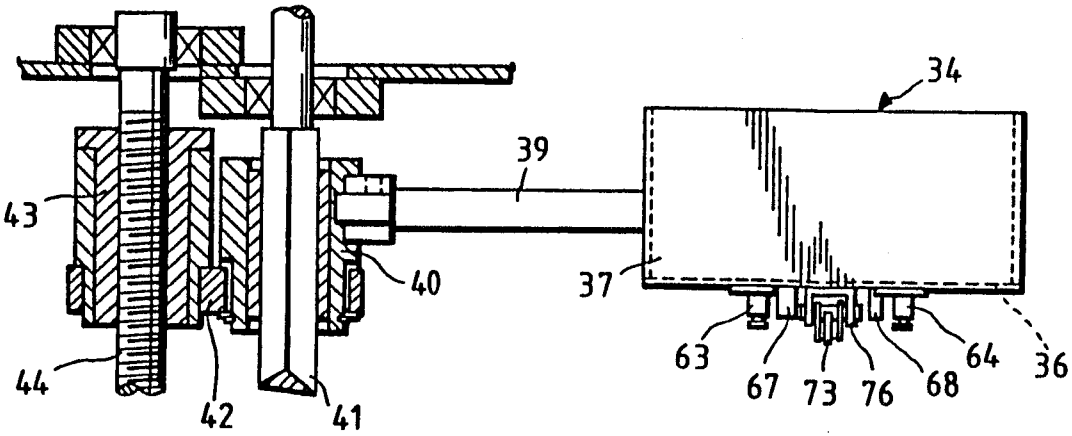
FIG. 9*a* is a view showing the state where a receiver is at a up position.

The package receiver 34 comprises, as shown in FIGS. 8 and 9, a substantially circular bottom plate 36 for placing and supporting an end of a yarn layer of a package, and a side wall 37 next thereto, which constitute a box-like body wherein one of side walls and one of grooves 38 formed in the bottom plate are opened approximately in a letter of U in plane.

One end of an arm 39 is secured to the side wall 37 of the receiver 34, and the other end of the arm 39 is secured to the side of a boss 40. The boss 40 is supported movably only up and down relative to a spline shaft 41, and the boss 40 is supported rotatably integral with the shaft 41 relative to an elevator 42. A nut 43 is secured to the elevator 42, and the elevator 42 and the boss 40 rotatably supported on the elevator 42 are moved up and down by the rotation of a threaded rod 44 threadedly engaged with the ut 43. As shown in FIG. 5, the threaded rod 44 is supported by bearing between upper and lower frames 45 and 46 and is rotated normally and reversely by a pulley 47 secured to the lower end and a motor not shown so that the elevator or the receiver 34 is moved up and down. At each stop position, a proximity switch is arranged so that a part of the elevator 42 is detected by the proximity switch to control the stoppage.

Figure 10:
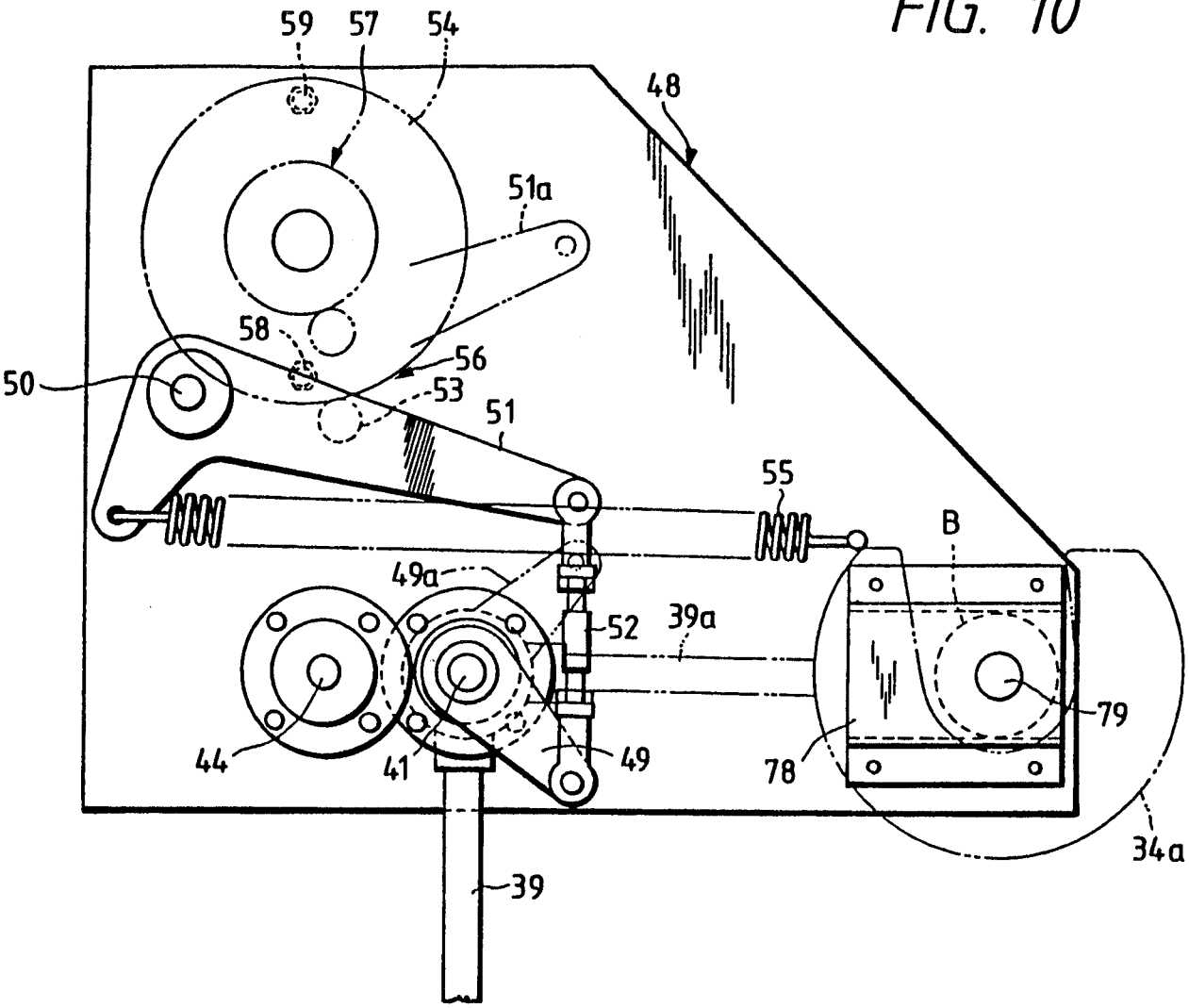
FIG. 10 is a plan view showing a driving system for a spline shaft and a threaded rod.

On the other hand, turning of the arm 39 is effected by the spline shaft 41 and the boss 40 fitted in the shaft 41. A drive mechanism 48 of the spline shaft 41 is shown in FIG. 10. That is, a lever 49 is keyed to the upper end of the spline shaft 41, and a rod 52 is connected between cam levers 51 pivotally mounted on a fixed shaft 50. A cam follower 53 is supported in the midst of the cam lever 51, and the cam follower 53 is urged by the force of a spring 55 against a cam plate 54 driven by a motor. The cam plate 54 is formed with a cam surface 56 of maximum radius and a cam surface 57 of minimum radius with a deviation of 180° in phase. Accordingly, as the cam lever 51 turns between the solid line position and the two-dot chain line position 51*a*, the lever 49 secured to the spline shaft 41 moves between the solid line position and the two-dot chain line position 49*a*. In the case of the present embodiment, the solid line position of the lever 49 is a position at which the receiver 34 receives a package from the spinning machine and a position at which an empty bobbin held by the receiver 34 is disengaged, and in the two-dot chain line position 49*a* of the lever 49, the receiver 34 is at the two-dot chain line 34*a* position in FIG. 10, position at which an empty bobbin on the tray T (T1 or T2, the same is applied to the hereinafter case) being located is held, and position at which the package on the receiver is supplied onto the tray T. An angle between the aforesaid positions 49 and 49*a* is 90°. Reference numerals 58 and 59 denote proximity switches for detecting a 180° rotated position of the cam plate 54, which sense the end of a large diameter portion of the cam plate to temporarily stop the turning of the arm.

In the receiver 34, as shown in FIG. 8, a groove 38 is formed in the bottom plate 36 so that the bobbin B may be relatively moved in, and a pair of empty bobbin holding members 61 and 62 are supported at 63 and 64 on the lower surface of the bottom plate 36 on both sides with the groove 38 sandwiched therebetween. The empty bobbin holding members 61 and 62 are urged in a direction of holding the empty bobbin B by means of coil springs 65 and 66 wound about the shafts 63 and 64 and come into abutment with stoppers 67 and 68 to be defined in position. Rollers 69 and 70 are supported on the extreme ends of the holding members 61 and 62, the rollers 69 and 70 pressing and holding the empty bobbin.

At a position corresponding to the deepest portion of the groove 38, a pressing member 71 for holding and disengaging the empty bobbin is screwed to the end of a lever 72, and as shown in FIG. 9*b*, a cam follower 73 at the end of the lever 72 supported on a shaft 75 of a bracket 76 engages a cam member 74 provided on the side of a fixed frame corresponding to the neighbourhood of a position at which the receiver moves down whereby the pressing member 71 integral with the lever 72 turns clockwise about the shaft 75. Accordingly, the pressing member 71 among three holding members for the empty bobbin, i.e., the rollers 69 and 70 and the pressing member 71 shown in FIG. 8 is disengaged, and as a result, the empty bobbin B falls down.

Figure 7:
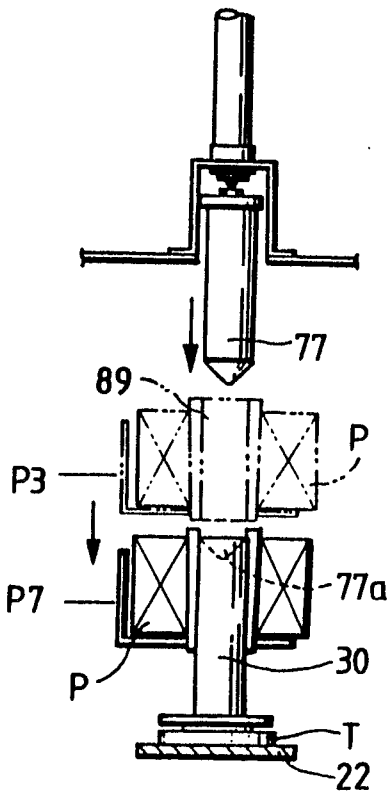
FIG. 7 illustrates the step by which a package is inserted.

In FIG. 5, upwardly of the tray T at the feed exchange position, a guide rod 77 for a package positioned on an axis of the support member 30 is provided movably up and down. That is, a guide rod 77 integrally formed with a flange portion 81, a columnar portion 82 and a conical portion 83 is secured to a piston rod 80 of a fluid cylinder 79 installed on a fixed frame 78 so that the guide rod 77 is moved up and down between a waiting position 77 and a lowermost position 77*a* indicated at two-dot chain line as shown in FIG. 7 by the action of the cylinder 79. At the lowermost position of the guide rod 77, the conical portion at the lower end is at a position at which the former is slightly moved into an opening at the upper end of the cylindrical support member 30.

Next, the operation of the feed exchange device will be described with reference to FIGS. 5 to 10.

First, in the layout shown in FIGS. 3 and 4, the empty bobbin B is stopped and positioned at the exchange station 25.

The feed exchange operation comprises two steps, including one step for removing the empty bobbin B on the tray T and the other step for mounting the package P from the spinning machine to the support member 30.

That is, in the first step, the receiver 34 turns by 90° counterclockwise in plane at the waiting position at a height of P4 and the empty bobbin B on the tray T is held by the holding members 61 and 62. Then, it moves up to a height of P2 to remove the empty bobbin B from the support member 30, and then the receiver 34 turns clockwise this time and moves down to the lowermost position P8. At the lowermost position, the cam 74 is present as shown in FIG. 9*b* to release the pressing member 71. Therefore, the empty bobbin B being held falls down and is received into the box (in FIGS. 1 and 3, 13) at a lower level.

Figure 6:
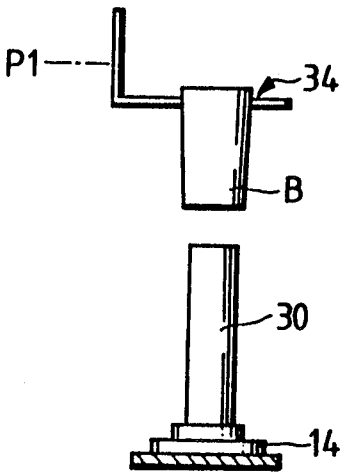
FIG. 6 illustrates the state where a bobbin is removed.

Next, the second step, the receiver 34 which has received the full package to be mounted next from the gage conveyor 5 at the height of P1 in FIG. 6 moves down to the position P3 in FIG. 7, after which it turns counterclockwise in plane and stops for a predetermine time at a position at which a package is mounted above the tray T. Within this time, the guide rod 77 shown in FIG. 7 move down to assume the two-dot chain line position 77*a* at which the lower end of the guide rod is slightly moved into the support member 30. At this time, since the guide rod 77 moves down passing through the center hole 89 of the package P in the standby state in FIG. 7, the center hold 89 of the package and the support member 30 are corrected in position on the same axis. The support member 30 is stood on the peg in the central portion of the tray T. Accordingly, the receiver 34 moves down to the position P7, and the full package P assumes the position shown in FIG. 7. The receiver 34 further reverses clockwise in plane whereby the package P and the receiver 34 are separated when the holding members 61 and 62 are opened, and the package P mounted on the support member 30 falls down by its own weight to a suitable position on the tray.

Next, the receiver 34 moves up to the uppermost position P1 to complete a supply of package.

In the manner as described above, yarn is exchanged at the feed exchange station 25 shown in FIG. 3. The tray T on which the full package P is placed is transferred in a direction as indicated at arrow 90 and is once reversed at 90, after which feed intervals on the conveyor 21 are substantially constant. The full package P which moves around the two-for-one twister is replaced by an empty bobbin on the spindles 8*a* and 8*b* by the operator of the carriage type doffing robot 10.

The package P1 need be mounted on the spindle 8*a*, and the package P2 need by mounted on the spindle 8*b*, as mentioned above.

In the present embodiment, in the case where the carriage type doffing robot 10 is used, the trays T1 and T2 are discriminated for discriminating the packages P1 and P2. A discriminator as mentioned below is provided on the robot 10.

Figure 18:
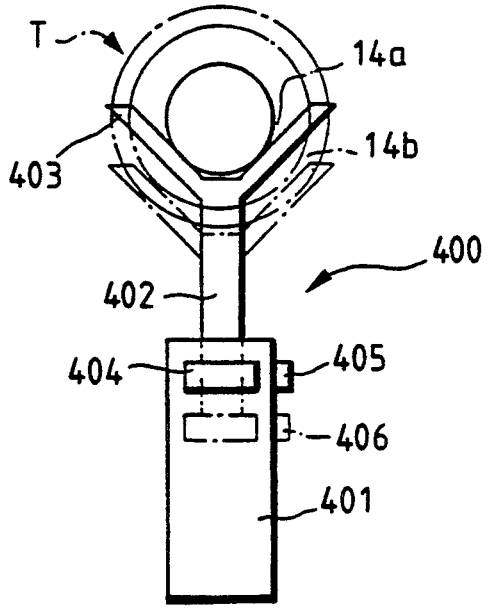
FIG. 18 is a plan view showing a package discriminator for a robot.

That is, in FIG. 18, a discriminator indicated at 400 comprises an air cylinder 401 mounted on the robot 10, a Y-shaped contact portion 403 provided at the extreme end of a piston rod 402 of the cylinder and proximity switches 405 and 406 for detecting the position of the piston 404. The contact portion 403 has a shape moved into the groove 14*a* or 14*b* of the tray T1 or T2.

In the discriminator 400, when the piston rod 402 is projected towards the tray T, if the tray T is the tray T1 having the deep groove 14*a*, the contact portion 403 deeply moves in as shown by the solid line and the proximity switch 405 is turned on, whereas if the tray T is the tray T2 having the shallow groove 14*b*, the contact portion 403 slightly moves into the tray as indicated by the phantom line and the proximity switch 406 is turned on.

Accordingly, by turning on and off the proximity switches 405 and 406, the trays T1 and T2, i.e., packages P1 and P2 can be discriminated.

In the above-described manner, supplying of the full package P from the gate conveyor 5 to the feed exchange device 6 and feed exchanging of the two-for-one twister 2 by the feed exchange device 6 are effected.

At the final end of the gate conveyor 5 is provided a chute 84 which urges a removal of the package P from the peg 4 to smoothly deliver the package P to the receiver 34, the chute 84 being formed of a plate bored with a slit in the central portion thereof through which the peg 4 may pass (FIGS. 3 and 4).

In this embodiment, a transfer device 85 is disposed between the carrier conveyor 3 frontwardly of the spinning machine 1 and the gate conveyor 5 to change the attitude of the package P. The transfer device 85 will be described hereinafter.

Figure 2:
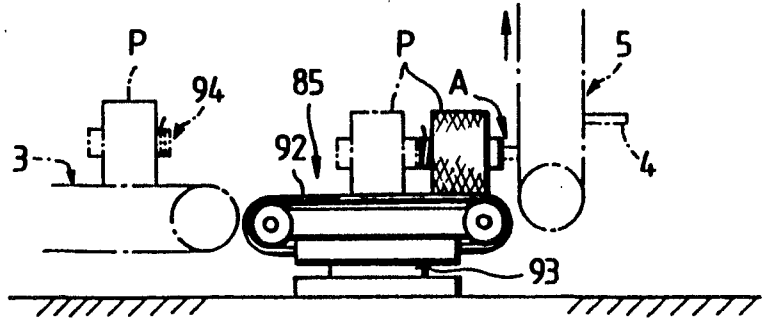
FIG. 2 is a side view of a transfer device.

The transfer device 85 comprises, as shown in FIG. 2, a belt conveyor 92 and a turning and driving device 93 for turning and driving the whole conveyor 92 about a vertical shaft. The device operates in the following.

That is, after the package P having been fed on the carrier conveyor 3 has been transferred onto the belt conveyor 92 shown in FIG. 2, the belt conveyor 92 slightly travels to move the package P to the nearly central portion on the belt conveyor 92 (as indicated at the two-dot chain line in FIG. 2). Then, the turning and driving device 93 is driven so that the package P is turned 180° about the vertical axis together with the belt conveyor 92. By this turning, the direction of the package P is reversed 180°, and the belt conveyor 92 again travels to transfer the central package P towards the gate conveyor 5. The gate conveyor 5 is intermittently moved during the turning of the belt conveyor 92 and the empty peg 9 assumes the position A in FIG. 2. When the belt conveyor 92 travels, the package P is inserted into the empty peg 4.

The reversal of the direction of the package P causes the punch winding 94 position in the package P from the spinning machine 1 to be directed upwardly in the two-for-one twister 2 after being carried. If the bunch winding 94 position of the package P doffed from the spinning machine 1 is reversed to that of the former example, the transfer device 85 is not necessarily required, and the carrier conveyor 3 of the spinning machine 1 may be connected directly to the start end of the gate conveyor 5.

Since in the transfer device 85, the conventional belt conveyor 92 is used, when the gate conveyor 5 is made to travel in the state shown in FIG. 2, the peg 4 and the belt conveyor 92 interfere this, and to make the gate conveyor 5 to travel, the belt conveyor 92 had to be turned around 90° about the vertical axis. However, if as the belt conveyor 92, a belt conveyor which is divided into two in the central portion thereof so that the peg 4 may pass therethrough even in the state shown in FIG. 2 is used, the gate conveyor 5 can be travelled irrespective of the direction of the belt conveyor 92.

Next, the spinning machine 1 in this embodiment will be described. The spinning units U have the same construction and therefore, one unit U will be described. The unit U in the unit groups U1 and U2 mentioned above is the same in construction. Yarns of different kinds are produced by changing the using material or by changing the spinning conditions such as air pressure of air jet.

Figure 11:
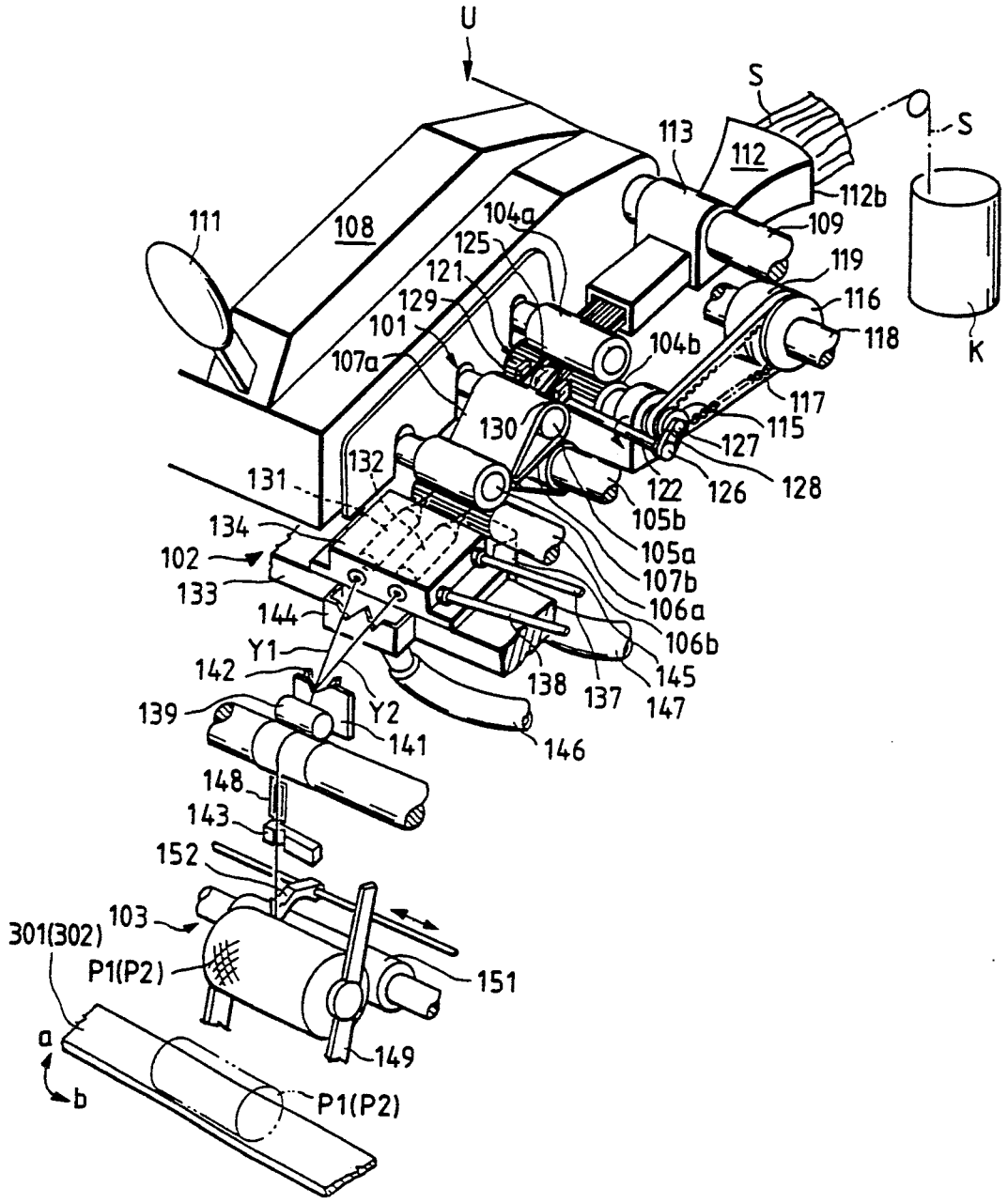
FIG. 11 is a perspective view showing one unit of a spinning machine.

FIG. 11 is a perspective view of said one unit which comprises a draft device 101 for drafting a sliver S supplied from a can K, a twisting device 102 for twisting the sliver S drafted by the draft device 101 to form a yarn, and a taking-up device 103 for taking-up the spun yarn.

In the following, the devices 101, 102 and 103 will be described with reference to FIGS. 11 to 14.

The draft device 101 comprises paired back rollers 104*a* and 104*b*, paired middle rollers 105*a* and 105*b* and paired front rollers 106*a* and 106*b*, whose peripheral speeds are set so as to be faster in order. The middle rollers 105*a* and 105*b* have apron belts 107*a* and 107*b*.

Reference numeral 108 denotes a cradle for supporting the rollers 104*a*, 105*a* and 106*a* on the top side of the rollers, the cradle being turnable about a support shaft 109 secured to the frame. Reference numeral 111 denotes a handle for raising the cradle 108, and 112 a guide for a sliver mounted on the support shaft 109 through a bracket 113. The guide 112 has an outlet 112 whose shape is a laterally extending flat shape so that the sliver S is formed into a somewhat laterally lengthy sectional shape and fed to the rollers 104 and 104*b*.

In the rollers 104*a*, 105*a*, 106*a*, 104*b*, 105*b* and 106*b*, with respect to the middle and front rollers, the rollers 105*a* and 106*b* are in the form of a line shaft which extends through the whole unit. The rollers are rotated when the line shaft is driven. With respect to the back rollers 104*a* and 104*b*, the roller 104*b* on the bottom side is independent in each unit. A line shaft 118 is operatively connected to the roller 104*b* through toothed pulleys 115 and 116 and toothed belt 117 for rotation. An electromagnetic clutch 119 is provided on the toothed pulley 116 so that when the clutch 119 is actuated or not actuated, the back rollers 104*a* and 104*b* are controlled in start and stop for each unit.

In this embodiment, a sliver separating guide device 121 which will be described below is provided between the back rollers 104*a* and 104*b* and the middle rollers 105*a* and 105*b*.

Figure 12:
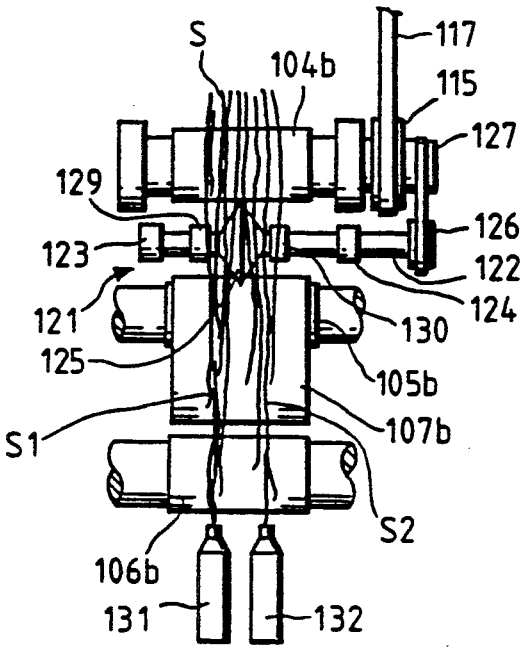
FIG. 12 is a plan view of a draft device with a top roller omitted.

That is, as shown in FIG. 12, a further shaft 122 is supported by bearings 123 and 124 between the back rollers 104*a* and 104*b* and the middle rollers 105*a* and 105*b*. A rotary member 125 having an approximately diamond shape in longitudinal section is secured to the shaft 122. A toothed pulley 126 secured to the end of the shaft 122 is connected by belt to a toothed pulley 127 secured to the pulley 115 so that the rotary member 125 may be rotated at the substantially same speed and in the same direction as the back rollers 104*a* and 104*b*.

The rotary member 125 is positioned in the central portion widthwise of the sliver S passage, and the peripheral edge portion thereof is at a position which projects upwardly extending through the sliver S passage so that the sliver S left from the back rollers 104*a* and 104*b* is separated into two rows S1 and S2 of the same width.

To left and right of the rotary member 125, guide blocks 129 and 130 are secured to the frame so as to define the expansion of the slivers S1 and S2 to left and right separated at the rotary member 125.

Two rows of the slivers S1 and S2 separated at the position of the rotary member 125 are drafted while maintaining the parallel two-row state even at the position of the middle rollers 105*a* and 105*b* and at the position of the front rollers 106*a* and 106*b* and then introduced into air injection nozzles 131 and 132 which will be described later.

The position of the rotary member 125 may be between the back rollers 104*a* and 104*b* and the sliver guide 112, in which case, the sliver guide 112 is interiorly provided with a partitioning wall 112*c* which divides the interior thereof into two left and right chambers so that the sliver S may be introduced in two rows at the position of the inlet 112i b of the sliver guide 112, then separation is well effected. That is, in this case, the sliver is already separated into two within a single can K or supplied from two cans.

A fixed separating guide member may be used in place of the rotary member 125. However, in the case where the fixed guide is used, fibers which constitute the sliver S moving within the draft device 101 at a predetermined speed become contacted with the fixed guide member and a so-called hook fiber possible occurs. Therefore, the separation guide device 121 for the sliver preferably comprises a motion member such as the aforesaid rotary member 125 which moves at a speed substantially equal to the moving speed of the sliver S at said position.

The twisting device 102 will be described hereinafter. In this example, the twisting device 102 has a housing 134 secured to a frame 133, within which two rows of air injection nozzles 131 and 132 comprising air nozzles 135 and 136 (hereinafter a nozzle at upstream referred to as a first nozzle 135, a nozzle at downstream referred to a second nozzle 136) provided in series are provided parallel with each other. The air injection nozzles 131 and 132 independently twist slivers S1 and S2 supplied to form spun yarns Y1 and Y2.

The air injection nozzles 131 and 132 have the same construction, and therefore only one of them will be described.

Figure 13:
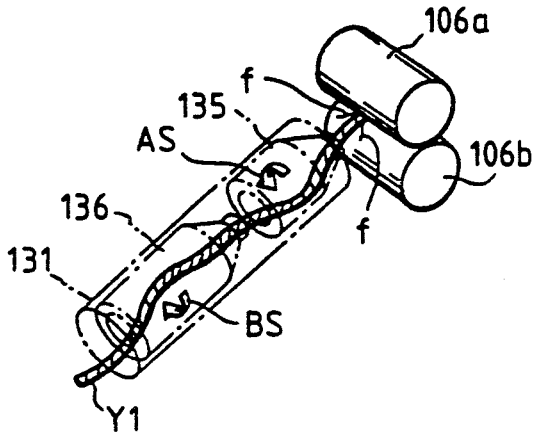
FIG. 13 is a perspective view showing a spinning mechanism by a twisting device.
Figure 14:
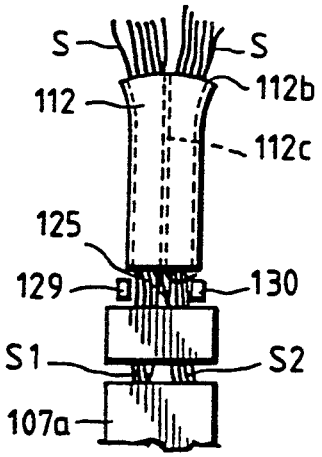
FIG. 14 is a plan view showing another example of a separation and guide device.

That is, as shown in FIG. 13, the first and second nozzles 135 and 136 are provided with a plurality of air injection fine-diameter holes (not shown) which inject air in a tangential direction towards the interior of a sliver S passage formed to extend through the center shaft. Air flows which turn in directions reversed to each other as indicated at arrows AS and BS are formed within the passage by said air injection holes. Reference numerals 137 and 138 denote supply pipes for pressure air to the first and second nozzles 135 and 136.

The spinning process by the air injection nozzles 131 and 132 is carried out in the following procedure.

The sliver S introduced into the passage is subjected to twisting by the turning air flow BS in said direction, and the twisting propagates to a point near the nip point by the front rollers 106*a* and 106*b*.

The sliver S issued out of the front rollers 106*a* and 106*b* is converged by the twisting caused by the second nozzle 136. However, the sliver S is ballooned in the direction reversed to the twisting by the first nozzle 135 between the front rollers 106*a* and 106*b* and the first nozzle 135. The rear end is still held on the front rollers 106*a* and 106*b* by this balloon and within the fibers which constitute the sliver whereas a fiber (an open end fiber) f which is freed is formed at the leading end. This fiber f is wound in the direction reversed to the twisting caused by the second nozzle 136 by the balloon in the direction reversed to the twisting between the front rollers 106*a* and 106*b* and the first nozzle 135 and the air flow AS of the first nozzle 135. This fiber f passes through the second nozzle 136 and the twisting is released, during which it is strongly wound into a core fiber bundle with sufficient turns in the direction reversed to the twisting inserted to form a so-called bundle spun yarn.

The spun yarn Y moved out of the air injection nozzles 131 and 132 is drawn out by means of a delivery roller 139, and two yarns are arranged and doubled at the position of the guide plate 141 provided directly before the delivery roller 139 and then wound by the winding device 103.

Accordingly, the two rows of air injection nozzles 131 and 132 may not be parallel but may be of the V-shaped arrangement wherein they connect the position of the guide plate 141 (doubling position) and the position of sliver outlet of the front rollers 106*a* and 106*b* or the arrangement wherein the first nozzles 135 and 135 are parallel and only the second nozzles 136 and 136 are directed toward the position of the guide plate 141 (doubling position).

Reference number 142 denotes a cutter provided at the position of the guide plate 141. The cutter 142 is actuated by a yarn defect detection signal from a slub catcher 143 which detects a yarn defect provided halfway of the yarn running area which moves down toward the winding device 103 via the delivery roller 139.

Reference numerals 144 and 145 denote dust suction ports for waste, fly, etc. Reference numerals 146 and 147 denote suction pipes for air.

Reference numeral 148 denotes a suction tube for removing a sagging of yarn called a slack tube, which sucks a yarn spun from the air injection nozzles 131 and 132 when spinning starts or during piecing to prevent sagging of yarn.

The taking-up device 103 comprises a bobbin supported on a well known cradle arm 149, a friction roller 151 in rolling contact with the bobbin (or a package) for rotation, and a traverse guide 152.

If the turning directions of the first and second nozzles 135 and 136 are reversed to each other on left and right sides and the winding direction of the fibers in the outer periphery of the bundle spun yarn moved out of the air injection nozzles 131 and 132 is reversed, that is, one is S-twist yarn while the other is Z-twist yarn, excellent yarn properties after being formed into a dual yarn are obtained as compared with the case where yarns of S-twist or Z-twist are put together by the action whereby the directivities are negated with each other.

Anyhow, in the aforementioned spinning machine, the sliver S supplied from the can K is separated into two rows (may be three or more rows depending on the shape of the separation guide device 121) in the midst of passage leading to the position of at least middle rollers 105*a* and 105*b* of the draft device 101, and the sliver S in its separated state passes through at least between the middle rollers 105*a* and 105*b* and the front rollers 106*a* and 106*b* for being subjected to drafting.

Accordingly, two rows of slivers S1 and S2 moved out of the front rollers 106*a* and 106*b* are respectively subjected to the desired drafting and introduced into the air injection nozzles 131 and 132 and spun as two spun yarns Y1 and Y2, which are further arranged at the position of the guide plate 141 to form a substantially single dual yarn, after which it is drawn out by the delivery roller 139 and taken-up about a single package P.

The spun yarns Y1 and Y2 moved out of the twisting device 102 are detected in its defect by the slub catcher 143, and the cutter 142 is actuated as mentioned above by said detection signal to cut yarns. The electromagnetic clutch 119 is also turned "OFF" depending on the detection signal so that the rotation of the back rollers 104*a* and 104*b* is stopped whereby the spinning from the twisting device 102 also stops.

Namely, with respect to two rows of slivers S1 and S2 and yarns Y1 and Y2, cutting of yarn and starting and stopping of spinning are simultaneously effected.

The slub catcher 143 is capable of detecting the presence or absence of yarn travel, namely, occurrence of natural yarn cut other than the detection of yarn defect.

As described above, in the spinning machine in this example, two spun yarns are substantially arranged into one yarn for each unit and wound on one package P, and then delivered to the carrier conveyor 3 through forwardly provided storage device 301 or 302 by the doffer carriage 7.

The package P delivered onto the carrier conveyor 3 is stood upright on the tray T which moves around the two-for-one twister 2 via the aforementioned transfer device 85, the gate conveyor 5 and the package exchange device 6, and supplied to the spindles 8*a* and 8*b* of the two-for-one twister 2 which is suitably empty by an operator or the robot 10. The yarn wound about the package P is a dual yarn obtained by doubling two yarns in each unit U of the spinning machine 1, and therefore, particular doubling process by the doubler is of course not necessary. The final package PA twisted and wound back by use of the packages P1 and P2 is an excellent package by no means inferior to conventional yarns produced after a multiplicity of post-processes.

Figure 15:
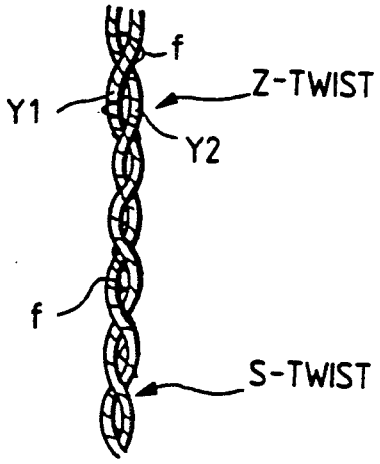
FIG. 15 illustrates the construction of a dual spun yarn produced.

That is, the yarns moved out of the air injection nozzles 131 and 132 and doubled at the position of the guide plate 141 are the bundle spun yarns to be spun via the mechanism as mentioned above shown in FIG. 13. Therefore the aforesaid yarn is a special dual yarn wherein spun yarns Y1 and Y2 which constitute a dual yarn are loosely entangled unlike a dual yarn in which when doubled at the position of the guide plate 141, an open end fiber f wound therearound becomes entangled with other spun yarns Y1 and Y2 by the residual torque (FIG. 15) and a dual yarn wound as a package P is obtained by simply arranging normal spun yarns parallel with each other. When such a package P is later applied to the two-for-one twister 2, separation of the dual yarn will not occur. Therefore, it is possible to obtain an excellent package which involves less cut in yarn and which contains no defective twist which is so-called corkscrew twist wherein one yarn has a sagged portion relative to the other. The spun yarns Y1 and Y2 entangled each other provide upper twists of alternate S-twist and Z-twist in the portion shown in FIG. 15 due to the residual torque of the open end fiber f and the residual torque of fiber which constitutes a core. Separation of the yarns Y1 and Y2 from each other in the post-process is well suppressed even by the upper twist.

While in the above-described embodiment, apparatus for producing a dual yarn package for each unit has been used as a spinning apparatus, it is to be noted that a conventional spinning apparatus, it is to be noted that a conventional spinning apparatus for providing a package for a single yarn for each unit may be used instead. An automatic winder for winding back a tube yarn from a spinning machine may be used in place of the spinning apparatus. That is, the spinning apparatus termed in this invention is a fiber machine provided with a winding device for winding a yarn on a package.

Furthermore, a conventional twisting machine may be used in place of the aforesaid two-for-one twister.

As described above, in accordance with this invention, a number of steps as mentioned above and devices for executing these steps are omitted, and devices and labor for transporting the packages between the steps are omitted. Yarns of different kinds can be automatically sorted, produced and twisted with extremely excellent producing efficiency.

What is claimed is:

1. A device for producing, sorting and twisting at least two different kinds of yarn, comprising:

a spinning device for simultaneously producing at least two types of yarn packages, the spinning device comprising a first plurality of spinning units for producing yarn packages of a first type, the packages of a first type comprising a first kind of yarn defining first predetermined characteristics and a second plurality of spinning units for producing yarn packages of a second type, the packages of a second type comprising a second kind of yarn defining second predetermined characteristics, the first predetermined characteristics differing from the second predetermined characteristics, a twisting device comprising a circulating conveyor for conveying yarn packages on trays, a carrier conveyor for transferring yarn packages from the spinning device to the twisting device, package exchange means for removing empty bobbins from trays and mounting yarn packages produced by the spinning device on trays, the package exchange means being operably connected to the spinning device and the twisting device, wherein at least one of the plurality of spinning units comprises:

a draft device for drafting a fiber bundle, a plurality of air injection nozzles for producing a corresponding plurality of spun yarns by applying a twist to the drafted fiber bundle, means for doubling the plurality of spun yarns to form a single, double yarn, and a take-up device for producing a package of the single, doubled yarn.

2. A device for producing yarn, comprising:

a spinning device for simultaneously producing at least two types of yarn packages, the spinning device comprising a first plurality of spinning units for producing yarn packages of a first type, the packages of a first type comprising a first kind of yarn defining first predetermined characteristics and a second plurality of spinning units for producing yarn packages of a second type, the packages of a second type comprising a second kind of yarn defining second predetermined characteristics, the first predetermined characteristics differing from the second predetermined characteristics, a twisting device comprising a circulating conveyor for conveying yarn packages of the first type on a plurality of trays of a first type and for conveying yarn packages of the second type on a plurality of trays of a second type, a carrier conveyor for transferring yarn packages from the spinning device to the twisting device, package exchange means for mounting yarn packages produced by the spinning device on the plurality of trays, first storage means associated with the first plurality of spinning units for temporarily storing yarn packages of the first type, second storage means associated with the second plurality of spinning units for temporarily storing yarn packages of the second type, sorting means associated with the circulating conveyor for sorting the plurality of trays according to type, and selection means for selecting trays to be transferred from the sorting means to the package exchange means, the selection means and the first and second storage means being operatively connected, whereby the first storage means releases at least one yarn package of the first type to the package exchange means when a tray of the first type is supplied to the package exchange means, and whereby the second storage means releases at least one yarn package of the second type to the package exchange means when a tray of the second type is supplied to the package exchange means.

3. The device as claimed in claim 2, wherein at least one of the spinning units comprises a winding device and wherein at least one of the first and second storage means comprises a rotatable plate provided between the winding device and the carrier conveyor, whereby rotation of the rotatable plate enables yarn packages temporarily stored by the storage means to be released and supplied to the carrier conveyor.

4. The device as claimed in claim 2, wherein each of the plurality of trays comprises a base having a groove therein, the groove defining a depth that corresponds to the type of the tray, wherein the sorting means defines a branch point and a plurality of passages on the circulating conveyor, and wherein the sorting means comprises a plurality of projecting plates located adjacent the branch point and positioned to engage the grooves of trays on the circulating conveyor, whereby each of the plurality of trays is directed onto one of the plurality of passages depending upon the depth of the groove in the tray.

5. The device as claimed in claim 4, wherein the selection means comprises a rotatable shaft and a stopper fixed to the rotatable shaft.

6. The device as claimed in claim 2, wherein the twisting device comprises a plurality of spindles and a doffing robot for exchanging full packages on trays circulating around the twisting device with empty bobbins on the spindles of the twisting device, the doffing robot comprising a discriminator for discriminating the type of the tray.

7. The device as claimed in claim 6, wherein each of the plurality of trays comprises a bas having a groove therein, the groove defining a depth that corresponds to the type of the tray, and wherein the discriminator comprises:

a piston rod and an associated cylinder associated with the doffing robot, a substantially Y-shaped contact portion positioned at an end of the piston rod for contacting the grooves of the trays on the conveyor, and a plurality of proximity switches for detecting the position of the piston rod.

8. A method for producing yarn, comprising:

providing a spinning device for simultaneously producing at least two types of yarn packages, the spinning device comprising a first plurality of spinning units for producing yarn packages of a first type, the packages of a first type comprising a first kind of yarn defining first predetermined characteristics and a second plurality of spinning units for producing yarn packages of a second type, the packages of a second type comprising a second kind of yarn defining second predetermined characteristics, the first predetermined characteristics differing from the second predetermined characteristics, providing a package exchange means for mounting yarn packages of the first type on trays of a first type and for mounting yarn packages of the second type on trays of a second type, providing a twisting device comprising a circulating conveyor for conveying yarn packages of the first type on trays of the first type and for conveying yarn packages of the second type on trays of the second type, supplying at least one tray of the first type to the package exchange means, transferring at least one yarn package of the first type from the first plurality of spinning units to the package exchange means in response to the step of supplying at least one tray of the first type to the package exchange means, supplying at least one tray of the second type to the package exchange means, and transferring at least one yarn package of the second type from the second plurality of spinning units to the package exchange means in response to the step of supplying at least one tray of the second type to the package exchange means.

9. A method for producing yarn, comprising:

providing a spinning device for simultaneously producing at least two types of yarn packages, the spinning device comprising a first plurality of spinning units for producing yarn packages of a first type, the packages of a first type comprising a first kind of yarn defining first predetermined characteristics and a second plurality of spinning units for producing yarn packages of a second type, the packages of a second type comprising a second kind of yarn defining second predetermined characteristics, the first predetermined characteristics differing from the second predetermined characteristics, providing a package exchange means for mounting yarn packages of the first type on trays of a first type and for mounting yarn packages of the second type on trays of a second type, providing a twisting device comprising a circulating conveyor for conveying yarn packages of the first type on trays of the first type and for conveying yarn packages of the second type on trays of the second type, wherein the step of providing a spinning device for producing yarn packages comprising:

providing a plurality of air injection nozzles for producing a corresponding plurality of spun yarns, doubling the plurality of spun yarns to form a single, doubled yarn, and taking up the single, doubled yarn to produce a package of the single, doubled yarn.

* * * * *